United States Patent [19]

Lindstrom

[11] 4,421,040

[45] Dec. 20, 1983

[54] FURNACE

[76] Inventor: Olle Lindstrom, Lorensviksv 14, S-18363 Täby, Sweden

[21] Appl. No.: 315,522

[22] PCT Filed: Mar. 6, 1981

[86] PCT No.: PCT/SE81/00071

§ 371 Date: Oct. 27, 1981

§ 102(e) Date: Oct. 27, 1981

[87] PCT Pub. No.: WO81/02619

PCT Pub. Date: Sep. 17, 1981

[30] Foreign Application Priority Data

Mar. 7, 1980 [SE] Sweden ..... 8001801

[51] Int. Cl.[3] ..... F23N 13/00

[52] U.S. Cl. ..... 110/294; 110/108; 110/116; 126/73

[58] Field of Search ..... 110/108, 116, 105, 293, 110/294, 229; 126/73, 74

[56] References Cited

U.S. PATENT DOCUMENTS

| | | | |
|---|---|---|---|
| 1,723,182 | 8/1929 | Kohout | 110/293 |
| 2,469,639 | 5/1949 | Franklin | 110/293 |

FOREIGN PATENT DOCUMENTS

| | | | |
|---|---|---|---|
| 116714 | 3/1899 | Fed. Rep. of Germany . | |
| 2711743 | 9/1977 | Fed. Rep. of Germany . | |
| 598405 | 12/1924 | France . | |
| 24950 | 3/1963 | German Democratic Rep. | 110/293 |
| WO80/01713 | 8/1980 | PCT Int'l Appl. . | |
| 201567 | 2/1939 | Switzerland . | |

*Primary Examiner*—Edward G. Favors

*Attorney, Agent, or Firm*—Burns, Doane, Swecker & Mathis

[57] ABSTRACT

An improved process of the type wherein a fuel is first pyrolyzed in a chamber (14) and the resulting volatiles and non-volatiles then transferred to a combustion region (18) for burning, the improvement comprising temporarily storing at least a portion of the volatiles in an enclosure (24) spaced from the chamber (14) and the combustion region (18) when volatiles production exceeds the volatiles incineration capability of the combustion region. Apparatus for carrying out the method of the invention is also disclosed.

5 Claims, 5 Drawing Figures

17
16
20
18
21
22
31
35
35
25
36
24
30
3
23
1
26
5
37
29
38
9
39
28
2
32
7
40
19
42
41
33
34
14
15

Fig. 3a
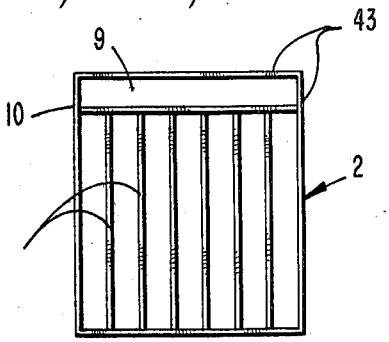
Fig. 3b
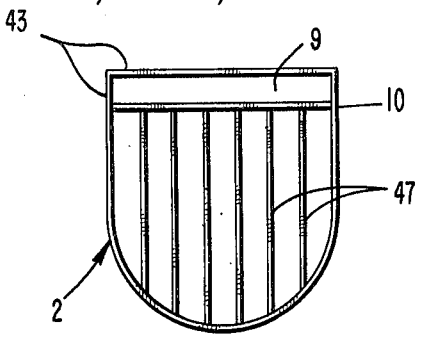
Fig. 3c
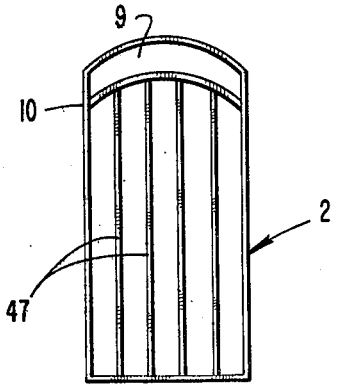
Fig. 3d
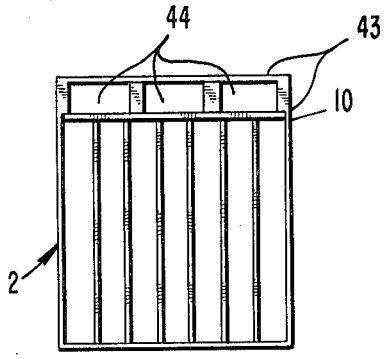
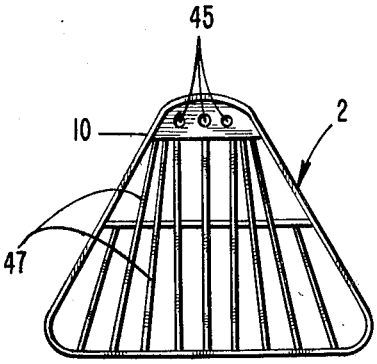
Fig. 3e
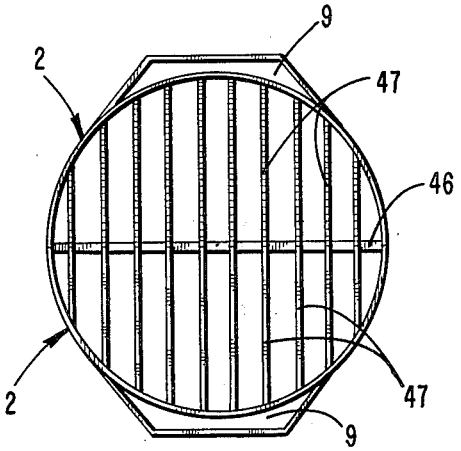
Fig. 3f

FURNACE

The present invention is concerned with a furnace for combustion of wood fuel and other similar non-slagging bio-fuels like peat, etc., said fuels kept in a container. These fuels are characterized also by a low ash content and considerable production of pyrolysis gas during heating with limited supply of air already at comparatively low temperatures. The residues which are formed during the pyrolysis are also quite reactive in the final processes of gasification and combustion.

This category of fuels is potentially very attractive from an environmental point of view because of, among other things, a frequently very low sulphur content. On the contrary these fuels contain organic nitrogen which gives nitrogen oxides also at rather low temperatures of combustion.

The thermochemical properties which have been indicated above have, however, so far constituted a complication. The large production of pyrolysis gas already at low temperatures constitutes a risk for uncontrolled emissions of cancerogenic polyaromatic compounds as well as precipitation of so-called creosote or tar in the chimney. Chimney fires in houses with wood burners have caused considerable damage.

During the last years the attention has been focussed on the emissions of cancerogenic substances in the combustion of fossil fuels as well as bio-fuels such as wood and peat. The risk for such emissions because of incomplete combustion is probably not negligible in combustion on a small scale with large pieces of fuel, e.g. logs, in furnaces which are primitive from a combustion technical point of view.

A primary purpose with the present invention is to supply a furnace which permits complete and environmentally acceptable combustion particularly of wood, peat and lignite also on a small scale for residential heat etc. with small emissions of nitrogen oxides, cancerogenic substances and particulate matter at a small excess of air.

A second purpose is to supply fast control of the heating power within wide limits to suit the actual demand.

A third purpose is to supply a simple procedure for charging with fuel with possibility to do something with the fuel in the fuel container if something should go wrong.

A fourth purpose is to produce a high efficiency and a high final temperature of combustion at good fuel economy and efficient utilization of the fuel gas heat.

A fifth purpose is to create conditions for simultaneous delivery of different kinds of energy from one and the same central unit from hot air for driers heated with hot air and saunas to warm water and warm air for residential heat etc.

A sixth purpose is to achieve the advantages enlisted above and corresponding properties also when burning fuel in the form of larger pieces like logs, briquettes, wood rods (compacted wood), pellets etc.

The invention will also produce a number of other advantages which will be evident from the following description.

The furnace according to the invention has been developed particularly for bio-fuels like wood and peat but can also be used with other fuels like lignite, etc. The furnace is also particularly suited for burning of boiler wood and logs but may also be fuelled with chips and other fuels in a finely divided shape. The furnace and its grid can be dimensioned and designed in detail for the fuel to be preferred.

The invention relies on a unique combination of geometrical and combustion chemical principles. A new principle of design has been derived for the functional elements of the furnace to permit a new combustion process which is suitable for the special properties of said preferred fuels as well as satisfying the above requirements with respect to complete and efficient combustion etc.

Many attempts have been made to design furnaces for efficient and complete combustion of wood fuels frequently in connection with container burning. Natural measures have been pre-heating of the combustion air, supply of secondary air in a special flame space or a design which forces developed gases through the hearth.

The Swedish Patent No. 6251 thus describes a furnace with a fuel container and a space surrounding this container where the combustion air is pre-heated. The wood is sinking down in the upright fuel container towards a horisontal grid with an ash box below the grid.

The Swedish Patent No. 7454 describes supply of primary air to the hearth which is arranged on a vertical grid with final combustion with supply of secondary air.

Other means and procedures which are in principle similar, are described in other earlier patents like the Swedish Patent Nos. 11515, 14383, 29004, 93794 etc.

The Swedish Patent No. 99156 describes combustion with an inverted container. Combustion is taking place in a horisontal hearth in the upper part of the fuel charge.

The Swedish Patent No. 99532 aims at complete combustion of secondary air by means of a furnace chamber which has a comparatively small width in relation to its length which gives the flame space the shape of a slot. The Swedish Patent No. 148925 shows also how preheated air is supplied for final combustion in a special chamber prior to the flame space. The Swedish Patent No. 118540 describes a gas flame outlet which is disposed in the middle part of a watercooled plane grid.

Efficient control of the combustion process may be obtained according to the Swedish Patent No. 109293 by having combustion air supplied to a larger or smaller part of a vertical grid area which in this case is disposed in the lower part of the fuel container.

None of these known designs satisfy the above requirements as well as the present invention which is concerned with a furnace for container firing of non-slagging solid fuels like wood, peat and lignite with a fuel container with a grid, a grid space and a flame space characterized in (a) that the grid is disposed in the lower part of the fuel container and is inclining against the horizontal plane
(b) that the grid space is at the lower part furnished with means for supply of reaction gas for gasification of the solid fuel
(c) that the grid is constructed of grid rods or grid elements which are directed upwards
(d) that the grid space is at its upper part connected to the flame space with a slot or construction
(e) that the flame space is furnished with means for supply of combustion air for combustion of the fuel gas in or next to the slot.

The invention shall now be described in some detail by means of the FIGS. 1, 2, 3, 4 and 5.

FIG. 3 shows different embodiments of the fuel container, grid, and grid space.

Figure 1:
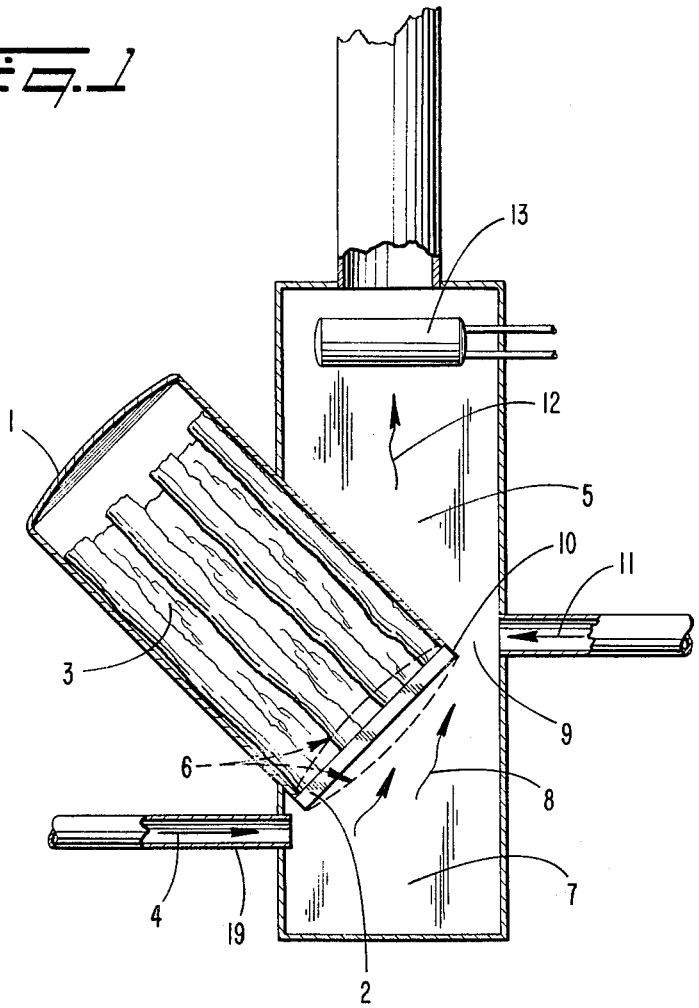
FIG. 1 shows completely schematically the principle for the new furnace.

FIG. 1 shows the geometrical conditions which in principle determine the process of combustion in the new furnace. The fuel container (1) ends downwards with an inclined fuel retainer in the form of a grid (2). An upper side of the grid is carrying the fuel charge (3) and a lower side faces a grid space 7. The reaction gas (4), which could be preheated air, is supplied to a thin zone of gasification (6) in or next to the grid (2) in the grid space (7). The fuel gas (8) which is formed during the gasification of the fuel is flowing towards a passage (9) at the upper edge of the grid (10) where it is mixed with combustion air (11) for combustion in the flame space (5) to form the flue gas (12) which is utilized for instance in a heat exchanger (13).

Figure 2:
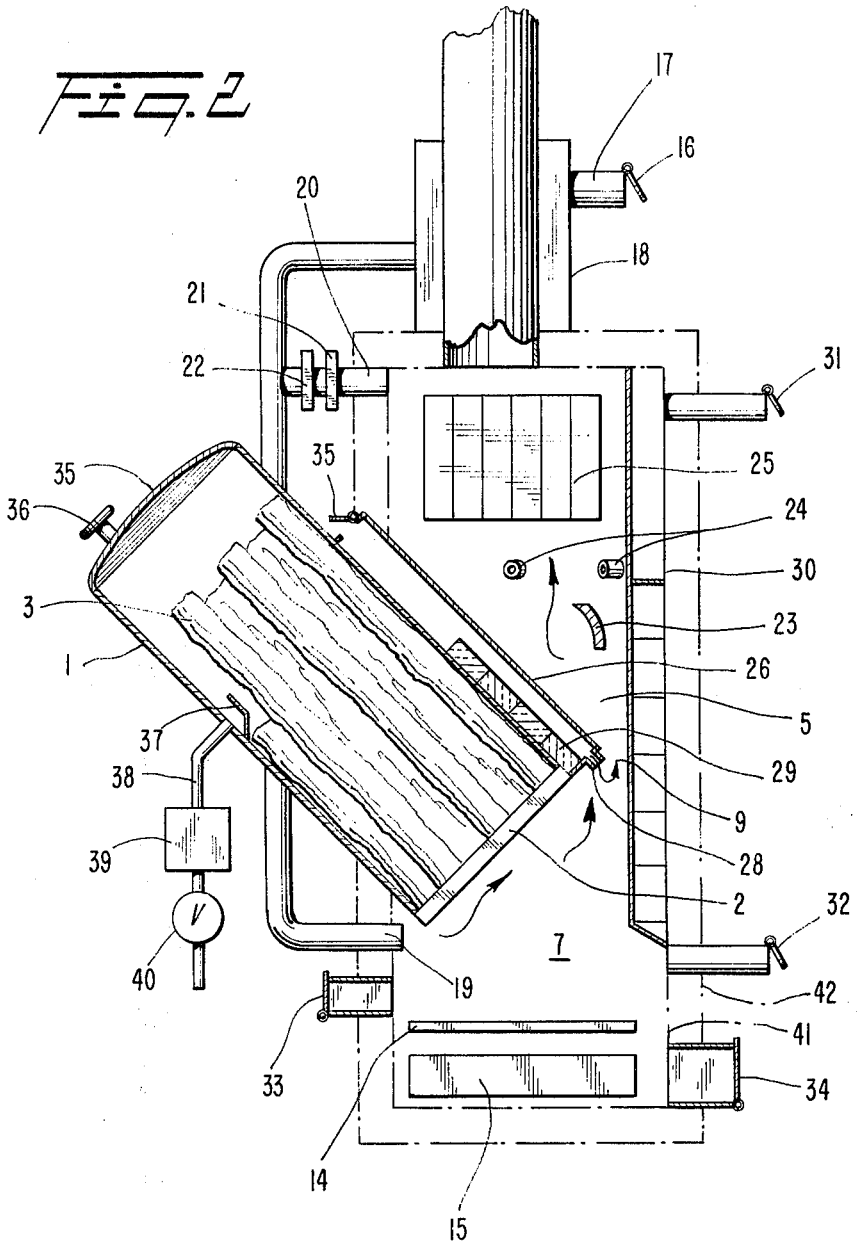
FIG. 2 shows a suitable embodiment leaving out constructive details.

FIG. 2 shows a furnace according to the invention in a preferred embodiment. FIG. 2 shows primarily the constructive factors which constitute conditional requirements for the new process. The fuel container (1), which may have a length of about 1 meter and a square section of about 0.2×0.2 meter for a small house, is ending downwards with the grid (2) which forms an angle with the horizontal plane as well as the fuel container itself, preferably around 30–60°. The grid, however, does not have to be arranged at a right angle towards the principal direction of the fuel container as is shown in FIG. 2. The grid may e.g. incline 60° against the horizontal plane as well as against the fuel container whereby the angle between the grid and the principal direction of the fuel container also amounts to 60°.

The range for the inclinations indicated above, 30–60°, are suitable values. The technical effect of the invention is also obtained with angles of the inclination for the corresponding elements which may be as high as 70–75°. In an extreme embodiment the fuel container is vertically disposed but is ending downwards with an inclined grid with grid rods directed upwards.

The fuel container (1) contains the fuel charge (3), e.g. logs, which are standing on the grid (2).

It is frequently useful to arrange another preferably horizontally disposed plane grid (14) for the purpose to catch not completely burnt out fuel which may fall through the grid (2). The ash is collected in the ash box (15).

The reaction gas for the combustion may be e.g. preheated air for partial combustion/gasification or hot flue gas with an addition of steam as is described in Pat. appl. No. 8001803-9 "Means for two-step combustion of wood, peat and similar fuels" submitted to the Patent Office this very same day. The reaction gas can also be supplied in a pulsing way according to another Pat. appl. No. 8001804-7 "Procedure for pulsing gasification" which also has been supplied to the Patent Office this day. In this case, however, air is used which is supplied via the damper (16) in the inlet tube (17). The air is preheated in the heat exchanger (18) prior to the outlet (19).

The fuel gas thus formed is flowing up along the grid (2) towards the slot or the constriction (9). The slot connects the grid space (7) with the flame space (5). The ratio of the surface of the slot and of the grid should be smaller than about 1:5, a preferred ratio is about 1:10 or below. The constriction (9) can be made as several parallel slots or slits or by a series of holes.

The hot flue gas contains nitrogen, carbon dioxide, steam and a small quantity of oxygen. The oxygen content is controlled by the air/fuel gas ratio in the flame space and by eventual extra supply of recirculated flue gas by the conduits (20) with the damper (21) and the fan (22).

A very fast pyrolysis and gasification of the fuel is taking place in the thin zone of gasification. The pyrolysis and gasification residue is oxidized by the oxygen in the reaction gas. Organic nitrogen compounds are decomposed down to nitrogen. The solid wood fuel is thus converted to an environmentally acceptable fuel gas.

The fuel gas is burnt in the flame space (5) by addition of air in or next to the slot where intense mixing is taking place. The area of the flame space is then increasing upwards which causes separation of particulate matter. The flame space may also contain baffles (23) so as to produce a circular gas movement. Additional air for final combustion and dilution can be added in inlets which are tangentially disposed (24) to produce a cyclone effect.

The heat in the leaving fuel gases is taken care of by means for heat exchange and heat recovery (25). For the production of warm air the temperature on surfaces in contact with the warm air should be lower than 75°–80° C. by dilution of the flue gas with off gas from the house and/or heat accumulating insulation according to the principle of the tile stove.

It is surprising that the principle of the inclined grid and the thin gasification zone will generate a fuel gas which can be combusted completely and in an environmentally acceptable way in the flame space. It is not possible to get a simple explanation to this feature.

Detailed analysis of differences between the object of the invention and other designs e.g. according to the Swedish patents cited above will however give some clues. None of these known designs give the same rapid and intense gasification process in a thin zone combined with the feature that all gases formed rapidly go to the flame space.

These conditions which can be described as flash pyrolysis/gasification according to the last findings in this area will give a fuel gas with a higher heating value and improved combustion properties depending on, among other things, a higher content of methane. The pyrolysis is also more complete with a smaller amount of pyrolysis residue which furthermore is more reactive in gasification and final combustion.

These suitable conditions are not obtained in earlier furnaces, which are characterized by larger active zones and because of this slower thermochemical processes and longer residence times for fuel gas formed which results in some thermochemical conversion of the primary formed pyrolysis products.

It may be added that the inclined grid in combination with supply of reaction gas at its lower edge also gives a number of practical advantages e.g. good final burn out of the fuel charge. The remaining fuel is collected at the end of the process on the lower part of the grid where it is brought in contact with incoming reaction gas which gives efficient final combustion also of the last remains of the pyrolysis- and gasification residues.

The inclined grid in combination with a large fuel container also permits operation on partial power with steady burn out also in the case of wood in pieces of large shape. This kind of wood is charged standing up in the fuel container and will fill up a larger or smaller part of the container which will produce an active thin zone in a larger or smaller part of the grid counted from its lower edge. It may in this case be useful to cover the upper free part of the grid area, which is not used, by e.g. an adjustable plate. The intense conditions for pyrolysis and gasification which characterize this invention may in this way be obtained also with smaller fuel charges.

FIG. 2 shows also means for supply of reaction gas and combustion air with additional details which do not restrict the scope of the invention but may be of value in its application.

It is frequently of advantage to preheat in a known manner the reaction gas as well as the combustion air. FIG. 2 shows a suitable embodiment for preheating of primary combustion air in this case. The fuel container (1) is equipped with a blanket (26) for preheating of air which is supplied by the adjustable damper (27) and is discharged to the flame space through the slot (28). It is in this case recommended to insulate the lower part of the fuel container by insulation (29) to prevent heating up of the fuel in the container.

Secondary air is preheated according to this example in the heat exchanger (30) which is taking up heat from the flame space. The secondary air is supplied by the adjustable damper (31) and is discharged to the flame space through the nozzles (24).

Additional air can be supplied to the grid (2) by means of the adjustable damper (32).

The furnace is preferably started by means of a solid starting fuel which is put on the grid (14) and introduced through the door (33). The ash box (15) can be pulled out through the door (34).

The fuel container is equipped with a lid (35) with the adjustable valve (36) for supply of flush air to the fuel container when required to prevent condensation of volatile products from the grid space towards the upper part of the fuel container. Condensate of moisture which may form in the upper part of the fuel container is let out by the collecting means (37) with the conduit (38) to the closed container (39) which is equipped with the let out valve (40).

The dashed lines (41) and (42) indicate the inner and outer surfaces of the furnace. Materials to use and design have to be decided from case to case depending on the location of the furnace (indoors or outdoors) and other conditions and constraints.

The furnace can be built in brick stone in its entirety in the known way. It is also possible to arrange the functional components in a steel construction which is then covered with steel plates and, when required, fire-resistant materials like fire resistant brick etc.

The space between the surfaces (41) and (42) can be filled up with insulating material and ballast material. The ballast material can be sand which can be easily filled into empty spaces between walls and furnace parts. The ballast material may also serve as heat accumulating material to give a kind of tile stove effect.

The furnace according to the invention is frequently used for hot water production. It is a simple task for the artisan to make use of components and techniques which have since long been used in this application for furnaces for residential heat fuel with gas, oil and solid fuel by introduction of water tubes and water blankets in the flame space. Desired preheating of the combustion air can in this case be obtained by a blanket around the fuel container according to FIG. 2 and by preheater tubes in the chimney.

It is not necessary here to describe all these possible embodiments as well as other conventional component parts like the chimney etc. Suitable fire resistant alloys are available in the market for the grid and other hot parts of the furnace, as well as suitable brick and insulating materials.

The main technical effect of the invention, the complete combustion, depends to some part on the separation into two steps. The surprisingly good effect must depend on the rapid pyrolysis in the narrow zone of gasification (6) which gives a reactive fuel gas with among other things methane for the flame combustion.

The residence time for the gas in the gasification zone is of the order of magnitude of 1 second during normal operation to be compared with residence times of the order of magnitude 10 seconds or above with state of art furnaces. This difference may have a large influence on the technical effect of the invention thanks to different thermochemical conditions which resemble those of so-called flash pyrolysis compared to slower processes in conventional furnaces as has been touched upon above. The conditions of flow for the gas, which is streaming up along the inclined grid, differ also most considerably from the conditions with a vertical or horizontal zone of gasification. The flowing conditions at the inclined grid with its grid rods directed upwards increases the rate of heat and mass transfer between the gas phase and the solid phase.

The heating power is primarily governed by the area of the grid. The dimensions which have been given as examples above for the furnace according to FIG. 2 give 15–20 kW of heat or above depending on fuel and combustion conditions.

A very small part of the fuel charge is each moment taking part in the process of gasification. The process may be described in a popular way so that the charge of fuel is consumed like a cigar with the glow at the grid. This process is a typical feature since only the lowest part of the fuel charge is taking part in it. Thanks to this the heating power can rapidly changed from spare power to full power and vice versa. The combustion process is of course controlled by control of the supply of the reaction gas e.g. air and the combustion air. In general it is desired to work with as low excess of air as possible. It is possible to operate near a stoichiometric air supply by careful adjustment of process conditions.

At simpler embodiments with natural draft and manual control of the registers under constant operation conditions one is helped by observation windows into the grid and the plane space respectively for adjustment of the supply of air. A fuel gas thermometer and observation of the combustion gas leaving the chimney gives additional aid at manual operations.

The furnace according to the invention is, however, very well suited for automatic control according to the various principles, which have been developed for other kinds of furnaces. This technical domain is today well known with many proven solutions and I may therefore restrict myself here to indicate a few suitable principles for automatic control.

The design of the control system is governed by a number of conditions like (a) the size of the furnace, (b) if the heat is used for production of hot water, hot air or warm air, (c) the properties of the fuel not least quality variations which may occur, (d) if several different fuels will be used, etc. There may also be different purposes with the control. One purpose may be to control the supply of air to get a reasonably constant and optimal burning out of the entire fuel charge. Another purpose may be to control the firing so that the furnace is delivering the heat power demanded under optimal combustion conditions independent of the power.

The first purpose corresponds e.g. to the use of the furnace as a wood stove. It is in this case recommended to control the supply of the reaction gas (air) and combustion air by means of mechanical control means for the dampers using bimetallic elements, which designs are frequent with different constructions of furnaces and stoves.

If the furnace is used for the production of warm water in the same way as a conventional oil fired furnace for residential heat it is also recommended to use the same kind of direct acting control measures. When the furnace is operating on spare power the supply is taking place by natural draft. A change to full power is obtained by activating air fans, either a main fan for all air supply, or two different fans for supply of reaction gas and combustion gas respectively. Another possibility is to use a flue gas fan in the chimney, the suction power of which is adjusted according to the demand.

Since the furnace is functionally separated in different zones for gasification and flame combustion there are many opportunities for more advanced process control. Such a system requires sensors in different parts of the furnace. The chimney is thus furnished with sensors for determination of the stack gas flow, temperature, content of oxygen and carbon monoxide etc. Sensors in the grate space give the fuel value and temperature of the fuel gas. The conditions in the flame space are characterized by temperature indicators on different levels. These informations are processed together with information about the demand in a mini-computer which is delivering control signals to adjustable dampers and fans so as to produce optimum combustion under different conditions.

Even if the furnace thus is well suited for such advanced control it may however in general be quite satisfactory with simple manual control, which is adjusted after the fuel in question, indoor temperature and warm water demand.

The FIGS. 3*a–f* show schematically elevations through different fuel containers in their lower part parallel with the grate. FIG. 3*a* thus shows the grate embodiment which is used in the furnace according to FIG. 2. The grate (2) has a square section in this embodiment. The thin and long slot (9) is demarcated by the lower edge of the fuel container (10) and the surfaces of demarcation (43), which are covered with fire resistant brick. FIG. 3*b* shows, using the same symbols, a fuel container with a partly circular section, thus eliminating the lower corners of the grate according to FIG. 3*a*, which are less efficient from a combustion point of view. FIG. 3*c* shows a further variation with a slot (9) formed as a bow and a comparatively long grate (2). FIG. 3*d* shows a constriction with several slots (44) and FIG. 3*e* a constriction consisting of several holes (45). FIG. 3*f* shows a double grate with two opposite, inclined surfaces connected with the beam (46). The common feature for these embodiments is the inclined grate with the grate elements (47) directed upwards, which conducts fuel gas formed in the gasification process towards a slot at the upper part of the grate, where the fuel gas is mixed with the combustion air for final combustion in the flame chamber.

The design and dimensioning of the grate (2) depend on many factors like the kind of fuel, the size of the furnace, etc. The grate shall keep the pyrolysis residue in place until it has been completely burnt out. The ash will then be pressed out through the grate to fall into the ash box (15). Fuel which has not been completely burn out is collected on the plane grate (14) for final combustion.

Pellet fuel requires grate element with smaller slots or openings than conventional grates. The grate shall produce a rapid and even supply of reaction gas over the entire grate surface and an evenly distributed discharge of fuel gas. Another important practical requirement is that it should be possible to remove pieces of non-reacted materials like e.g. nails from construction waste, cans from municipal refuse etc.

Many different grate designs are available and in practical use. The Swedish Patent No. 111352 describes furnaces with fuel container and inclined grate. Combustion is here taking place in a combustion chamber disposed below the grate whereby the gases in principle flow downwards towards the stack gas channel. The principle with a regulator controlled by the temperature for governing the supply of air to the different parts of the grate may, however, also be used with the present invention.

Different measures may be used for control of the flows of reaction gas and fuel gas e.g. by means of grate element with wings according to the Swedish Patent No. 5805 or by means of grate with a slot size which has been optimized for even supply of reaction gas according to the Swedish Patent No. 7021. The grate rods may also be furnished with air channels according to the Swedish Patent No. 50499.

More advanced grate designs use liquid cooling partly to recover heat, partly to increase the life of the grate, e.g. according to the Swedish Patent No. 35168. The Swedish Patent No. 81188 describes such a lquid cooled grate which furthermore is movable. Mechanical movement of the grid is frequently a valuable feature. The artisan experiences no difficulty when using these grate designs and other known designs for the proper design of the present grate with its grate elements directed upwards or other grate elements with the same function.

Figure 4A:
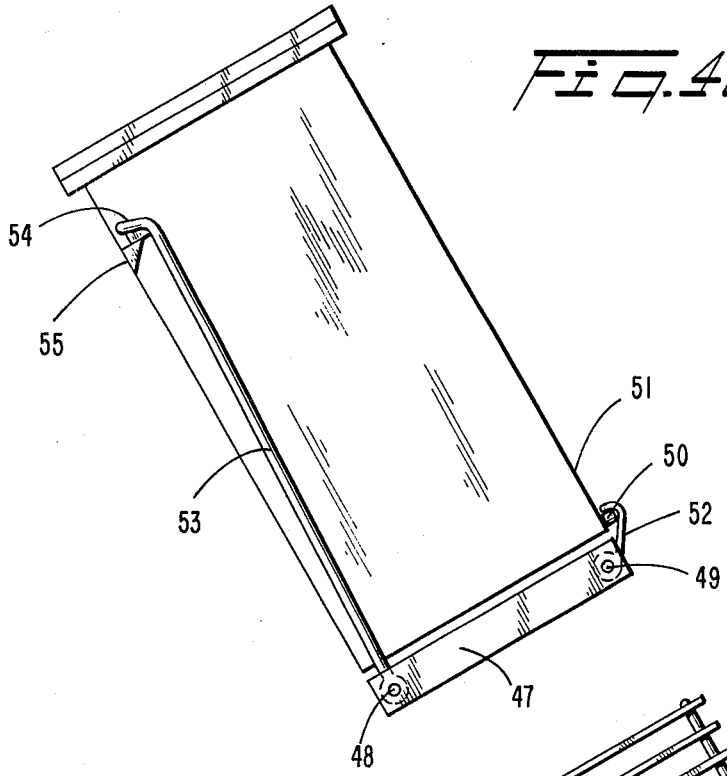
FIG. 4 shows a suitable grid design.
Figure 4B:
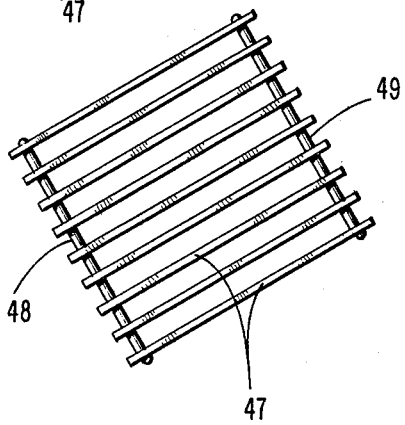

FIG. 4 shows a simplest conceivable embodiment of the grate which meets all requirements in the case of wood burning very well. The grate elements (47) are made of fire resistant alloyed steel and they have in this example a width of 3 mm and a height of 3 cm. The grate elements are arranged as a lattice by means of the transversal connecting rods (48) and (49). The lattice grate is supported so it can be moved in its upper edge against a rod (50) which is connected to the edge of the fuel container (51). FIG. 4 shows how the grate can be clamped to the fuel container in a simple way by having the outermost grate elements and also preferably some intermediate elements furnished with attachments (52).

The grate is kept against the lower part of the fuel container by means of the grate bar (53) which is connected with the lower supporting rod (48). The grate bar is resting against the underside of the fuel container and is shaped as a handle (54) in its upper part which is locked against an attachment disposed in the fuel container (55). One may easily clean the grate by loosening the handle to open the grate towards the ash box door whereby material on the grate is falling down into the ash box (15) through the opening, which is then formed at the lower part of the grate.

Figure 5:
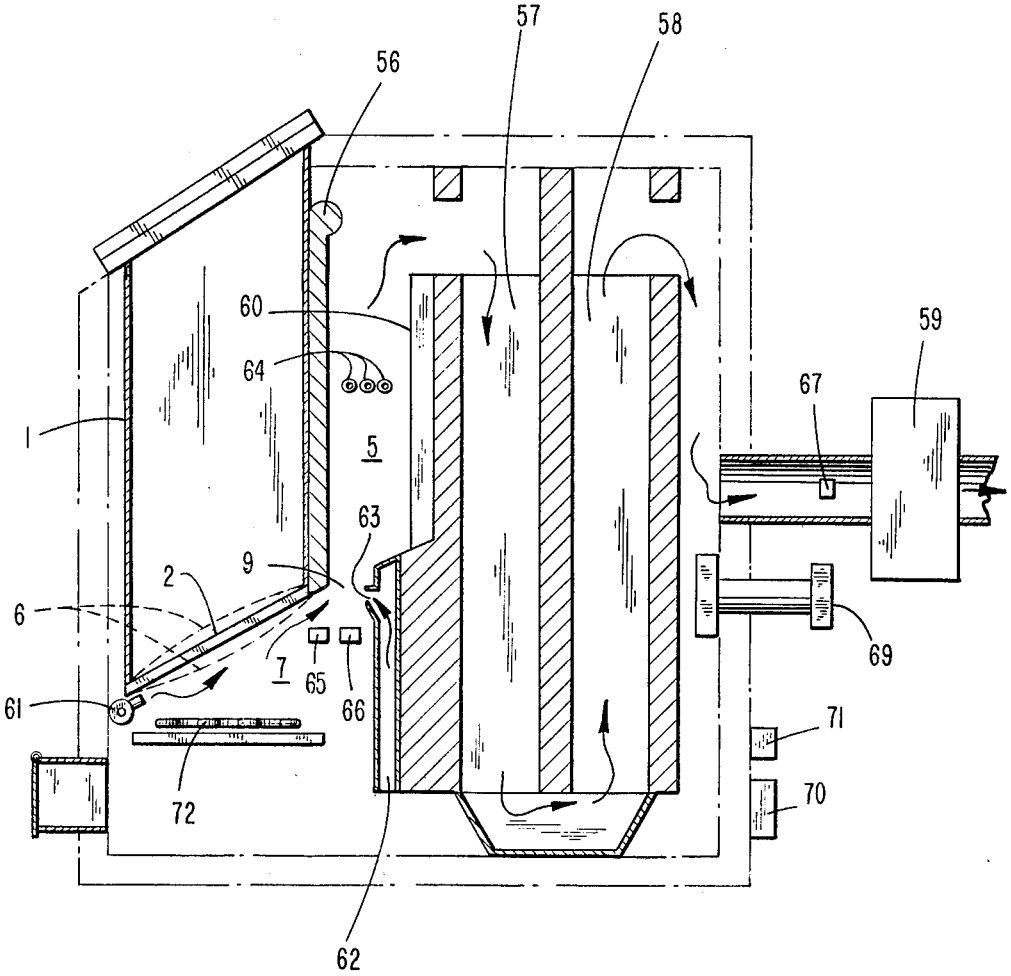
FIG. 5 shows finally a block scheme for a complete heating system for a small house with a furnace according to the invention disposed in a central unit.

FIG. 5 shows in a very schematic way the different components in a central unit with furnace according to the present invention. The central unit constitutes an addition to an existing house and is therefore put up outside the house as an independent unit with its own chimney.

A central unit can deliver different kinds of energy to the house, e.g. warm air for heating, warm water for consumption to wash the dishes, showers etc. as well as other useful commodities like hot air for a sauna e.g.

For the sake of simplicity the central unit shown in FIG. 5 is intended for conventional water carried heat. Excluding the characteristic features of the invention, i.e. the design of the grate, the grate space and the flame space and the means for supply of reaction gas, primary air and secondary air, the hot water generator shown in FIG. 5 has much in common with known furnaces e.g. the furnace type Osby VRT 2500 which is installed at the hotwater unit at KA 1 at Rindö, Vaxholm, Sweden. A description of experiments with combustion tests in this conventional furnace is given in a report from Angpanneföreningen, Stockholm, to the Board for Energy Source Development, Stockholm, Project No. 3066261, dated Sept. 7, 1978.

A water blanket (56) which is part of the hot water system is protecting the fuel container (1) from radiation in the flame space (5). Heat from the combustion gases is taken care of in the tube bundles (57) resp. (58), which carry the combustion gas to the outlet through the chimney which is containing a flue gas fan (59).

The reaction gas consists of air which has been preheated to about 500° C. in the air preheater (60) prior to the inlets in the nozzles (61). The primary combustion air is heated in the heater (62) and carried to the nozzles (63) disposed in the slot (9) between the grate space (7) and the flame space (5). Secondary combustion air is supplied through the nozzles (64) disposed in the flame room.

A fuel gas thermometer (65) and a fuel gas analyzer (66) are disposed in the grate space and a fuel gas thermometer (67) prior to the outlet to the flue gas channel. Air to be used as reaction gas, primary and secondary combustion air, is supplied via the air intake (68) and is then distributed between the preheaters (60 and 62) and the nozzles (64) in the distributing box (69) which is supplied with a register.

The register in the distributing box is maneuvred by means of positioners which receive control signals from a control unit (70) furnished with a mini-computer (71).

The combustion conditions of course depend on the kind of fuel used and its moisture content. In general the various flows are controlled to give a flame space temperature in the range 1200°–1400° C. and a flue gas temperature in the range 150°–200° C. The combustion is quite complete with negligible soot formation and tar precipitation even at such low air excess as 20–30% counted on the composition of the flue gas.

The grate space can be furnished with an electric heater (72) for ignition. Radiation from the element (72) rapidly heats adjacent parts of the fuel charge which starts to glow and then to burn. Such electrical means of course must be designed and mounted according to existing regulations.

The central unit according to FIG. 5 is well suited also for high power e.g. for district heating plants etc. The same design principle may, however, also be used with advantage for smaller units for small houses etc. The tube bundles in the convection section may then be substituted for simple water blankets. Such a small furnace can also be supplied with an electric heater in a known way and be combined with other systems for warm water production like solar heat systems with solar collectors. An interesting combination is to connect the warm water system in the central unit with a heat exchanger disposed in the chimney for the open fire place of the house according to an example in the Swedish Patent application No. 8001800-5 which was filed simultaneously. The heat which remains after production of warm air for space heating is here taken care of according to the patent application in a heat exchanger which is connected to the same system as the central unit according to FIG. 5.

A variation is to convert energy in the hot water which is produced in the central unit to airborne heat in the house after heat exchange in the so-called aerotemper.

A larger central unit has to be operated with a power which is following the demand whereas a smaller one can be run in two modes of operation, i.e. spare power and full power respectively. Full power is put on when the warm water temperature is too low and spare power is put on when the desired temperature has been reached.

The different elements in the central unit can advantageously be arranged in a steel construction with plates which separate the different compartments in the unit. The unit is insulated in a known way and is covered with a steel panel, wood panel, brick-stone etc. The central unit, which is placed outdoors, can be designed to harmonize with the exterior of the house. Putting it outdoors gives safety against fires and fumes indoors. It is also a practical advantage to fill the fuel container and to remove ash outdoors. The pile of wood can advantageously be put up against a wall near the central unit under a rain cover.

The foregoing description has only considered the special features for the furnace according to the invention. A few preferred embodiments have also been described so as to help the artisan in the application of the invention. The subject of the invention is however not limited to these special embodiments.

I claim:

1. A furnace for the container firing of non-slagging solid fuels such as wood, peat, and lignite, said furnace comprising:

a housing enclosing therewithin a grid space and a flame space, the latter disposed above the former, a fuel container for retaining said non-slagging solid fuel, said container including an upper portion and a lower portion, at least said lower portion being disposed within said housing, a perforate fuel retainer disposed across said lower portion of said fuel container, said retainer being inclined relative to horizontal so as to extend upwardly generally toward a restricted passage which interconnects said grid space and said flame space, said retainer including an upper side against which said solid fuel engages, and a lower side facing toward said grid space, means for introducing reaction gas into said grid space at a location below said retainer to support combustion of said fuel within a gasification zone extending along said retainer, with fuel gas formed by such combustion flowing to said flame space through said passage, and means for introducing combustion air to a location adjacent said passage to support combustion of said fuel gas within said flame space.

2. A furnace according to claim 1 wherein said retainer is inclined relative to horizontal at an angle of from 30 to 60 degrees.

3. A furnace according to claim 1 wherein said retainer comprises a planar grate.

4. A furnace according to claim 1 wherein said retainer includes upper and lower edges, said upper edge being rotatably mounted to said lower portion of said container, and means coupled to said retainer adjacent said lower edge for raising and lowering said lower edge relative to said container.

5. A furnace according to claim 1 wherein said means for introducing combustion air comprises a conduit disposed in said fuel space and extending along an upper side of said fuel container, said conduit having an inlet communicating with an upper end of said flame space and an outlet disposed intermediate said passage and an upper edge of said retainer.

* * * * *